US010054902B2

(12) United States Patent
Kitagawa et al.

(10) Patent No.: US 10,054,902 B2
(45) Date of Patent: Aug. 21, 2018

(54) TONER CASE AND IMAGE FORMING APPARATUS

(71) Applicant: KYOCERA Document Solutions Inc., Osaka (JP)

(72) Inventors: Hiroaki Kitagawa, Osaka (JP); Teruyuki Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/791,468

(22) Filed: Oct. 24, 2017

(65) Prior Publication Data

US 2018/0120760 A1 May 3, 2018

(30) Foreign Application Priority Data

Nov. 1, 2016 (JP) ..... 2016-214626

(51) Int. Cl.
*G03G 15/08* (2006.01)
*G03G 21/16* (2006.01)

(52) U.S. Cl.
CPC ..... *G03G 21/1647* (2013.01); *G03G 15/0865* (2013.01); *G03G 21/1652* (2013.01); *G03G 2215/0827* (2013.01)

(58) Field of Classification Search
CPC ..... G03G 15/0865; G03G 21/1647; G03G 21/1857; G03G 21/1864
See application file for complete search history.

(56) References Cited

U.S. PATENT DOCUMENTS 8,678,386 B2 * 3/2014 Hata ..... B65H 29/125 271/272
2016/0091857 A1 * 3/2016 Hashimoto ..... F16H 7/0827 399/117
2017/0185032 A1 * 6/2017 Itabashi ..... G03G 15/0875

FOREIGN PATENT DOCUMENTS

JP 2001-305841 A 11/2001

* cited by examiner

*Primary Examiner* — Gregory H Curran
(74) *Attorney, Agent, or Firm* — Studebaker & Brackett PC

(57) ABSTRACT

A toner case includes a case main body, a rotator, a transmitter and a turner. The rotator is stored in the case main body and rotates around a rotation axis. The transmitter transmits rotation to the rotator. A part of the transmitter is exposed to an outside of the case main body. The turner is provided at an outside of the case main body in a rotation axis direction. The turner is turnable between a first posture and a second posture. At least a part of the turner is moved to an outside in the rotation axis direction as the turner turns from the first posture to the second posture. The transmitter moves from a first position to a second position which is arranged at an outside of the first position in the rotation axis direction as the turner turns from the first posture to the second posture.

12 Claims, 11 Drawing Sheets

TONER CASE AND IMAGE FORMING APPARATUS

INCORPORATION BY REFERENCE

This application is based on and claims the benefit of priority from Japanese Patent application No. 2016-214626 filed on Nov. 1, 2016, which is incorporated by reference in its entirety.

BACKGROUND

The present disclosure relates to a toner case and an image forming apparatus including the toner case.

An image forming apparatus, such as a printer, a copying machine, a facsimile and a multifunctional peripheral, includes a toner case which replenishes a developing device with a toner (a developer). For instance, the toner case includes a case main body in which the toner is stored, a rotator stored in the case main body and rotating around a rotation axis and a transmitter which is exposed to an outside of the case main body and transmits rotation to the rotator. In such a toner case, by transmitting the rotation from the transmitter to the rotator in a state where a discharge port provided on the case main body is opened, the toner in the case main body is conveyed toward the discharge port and discharged outside the case main body.

SUMMARY

In accordance with an aspect of the present disclosure, a toner case includes a case main body, a rotator, a transmitter and a turner. The case main body stores a toner. The rotator is stored in the case main body and rotates around a rotation axis. The transmitter transmits rotation to the rotator. At least a part of the transmitter is exposed to an outside of the case main body. The turner is provided at an outside of the case main body in a rotation axis direction of the rotator. The turner is turnable between a first posture and a second posture. At least a part of the turner is moved to an outside in the rotation axis direction as the turner turns from the first posture to the second posture. The transmitter is movable between a first position and a second position which is arranged at an outside of the first position in the rotation axis direction. The transmitter moves from the first position to the second position as the turner turns from the first posture to the second posture.

In accordance with an aspect of the present disclosure, an image forming apparatus includes the above toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a multifunctional peripheral 1 (an example of an image forming apparatus) according to an embodiment of the present disclosure will be described. Arrows Fr, Rr, L, R, U and Lo shown in each figure respectively indicate a front side, a rear side, a left side, a right side, an upper side and a lower side of the multifunctional peripheral 1.

Firstly, an entire structure of the multifunctional peripheral 1 will be described.

Figure 1:
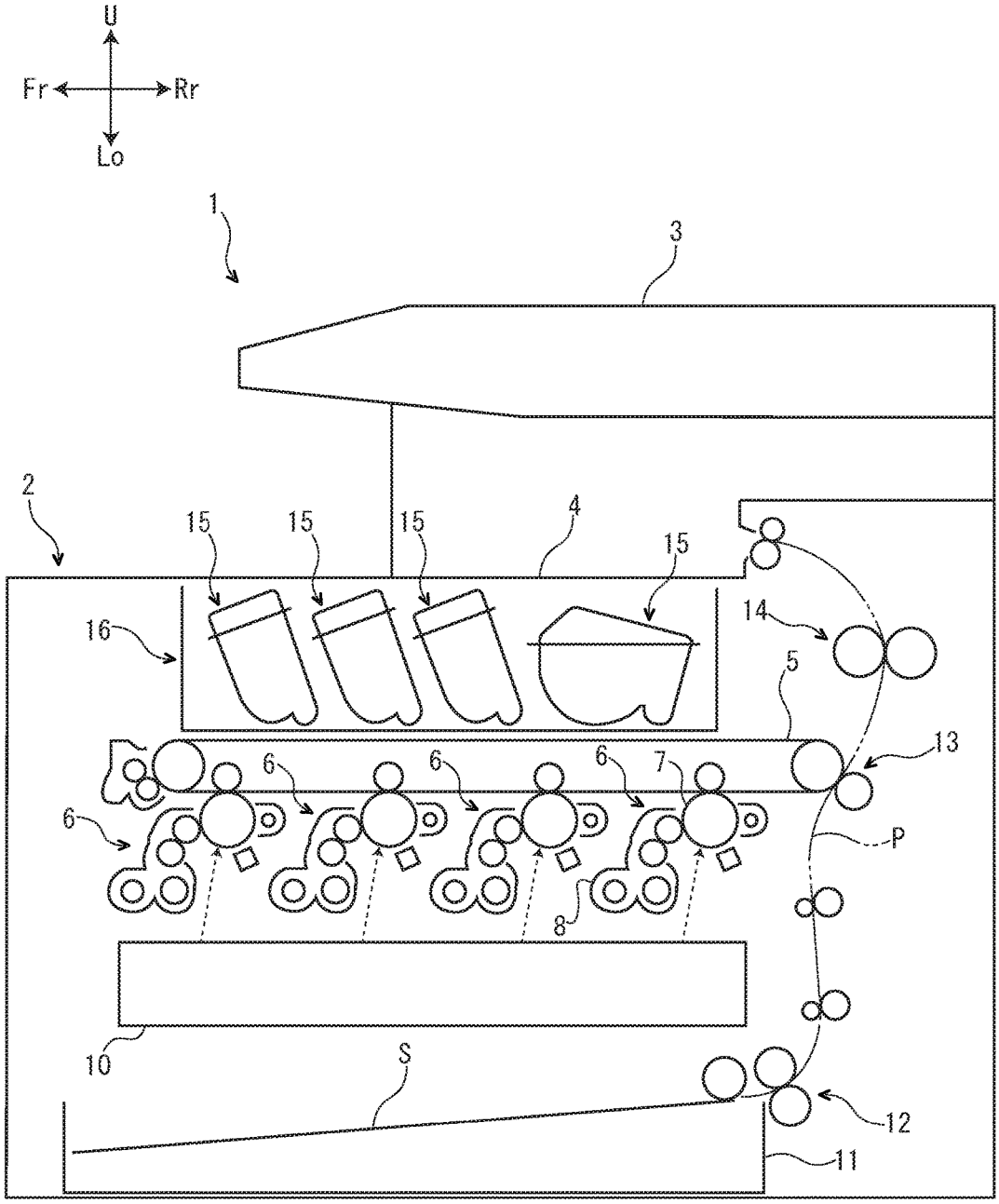
FIG. 1 is a schematic view showing a multifunctional peripheral according to an embodiment of the present disclosure.

As shown in FIG. 1, the multifunctional peripheral 1 includes a box-shaped multifunctional peripheral main body 2 (an example of an apparatus main body). On an upper end of the multifunctional peripheral main body 2, an image reading device 3 configured to read a document image is provided. In an upper portion of the multifunctional peripheral main body 2, an ejected sheet tray 4 is provided. In an approximate center portion of the multifunctional peripheral main body 2, an intermediate transferring belt 5 and four image forming parts 6 are stored. Each image forming part 6 corresponds to a toner (a developer) of black, cyan, magenta and yellow, in this order from the rear side. Each image forming part 6 includes a photosensitive drum 7 (an example of an image carrier) and a developing device 8. In a lower portion of the multifunctional peripheral main body 2, an exposing device 10 is stored. In a lower end portion of the multifunctional peripheral main body 2, a sheet feeding cassette 11 which stores a sheet S (an example of a recording medium) is stored.

In a rear side portion of the multifunctional peripheral main body 2, a conveying path P for the sheet S is provided. At an upstream end of the conveying path P, a sheet feeding part 12 is provided. At a middle portion of the conveying path P, a secondary transferring part 13 is provided. At a downstream portion of the conveying path P, a fixing device 14 is provided.

In the upper portion of the multifunctional peripheral main body 2, four toner containers 15 (an example of toner cases) are provided under the ejected sheet tray 4. Each toner container 15 corresponds to the toner of black, cyan, magenta and yellow, in this order from the rear side. Each toner container 15 is detachably attached to an attachment part 16 provided at the upper portion of the multifunctional peripheral main body 2.

Next, an operation of the multifunctional peripheral 1 will be described.

Firstly, light (refer to a dotted line arrow in FIG. 1) emitted from the exposing device 10 exposes the photosensitive drum 7 of each image forming part 6 to form an electrostatic latent image on the photosensitive drum 7. The electrostatic latent image is developed by the developing device 8 of each image forming part 6. Thereby, a toner image is carried on the photosensitive drum 7. The toner image is primarily transferred on the intermediate transferring belt 5 from the photosensitive drum 7 of each image forming part 6. Thereby, a full color toner image is formed on the intermediate transferring belt 5.

The sheet S fed from the sheet feeding cassette 11 by the sheet feeding part 12 is conveyed to the downstream side along the conveying path P and enters the secondary transferring part 13. At the secondary transferring part 13, the full color toner image formed on the intermediate transferring belt 5 is secondarily transferred on the sheet S. The sheet S on which the toner image is transferred is conveyed to the downstream side along the conveying path P and enters the fixing device 14. The fixing device 14 fixes the toner image on the sheet S. The sheet S on which the toner image is fixed is ejected on the ejected sheet tray 4.

Next, each toner container 15 will be described in detail.

Figure 2:
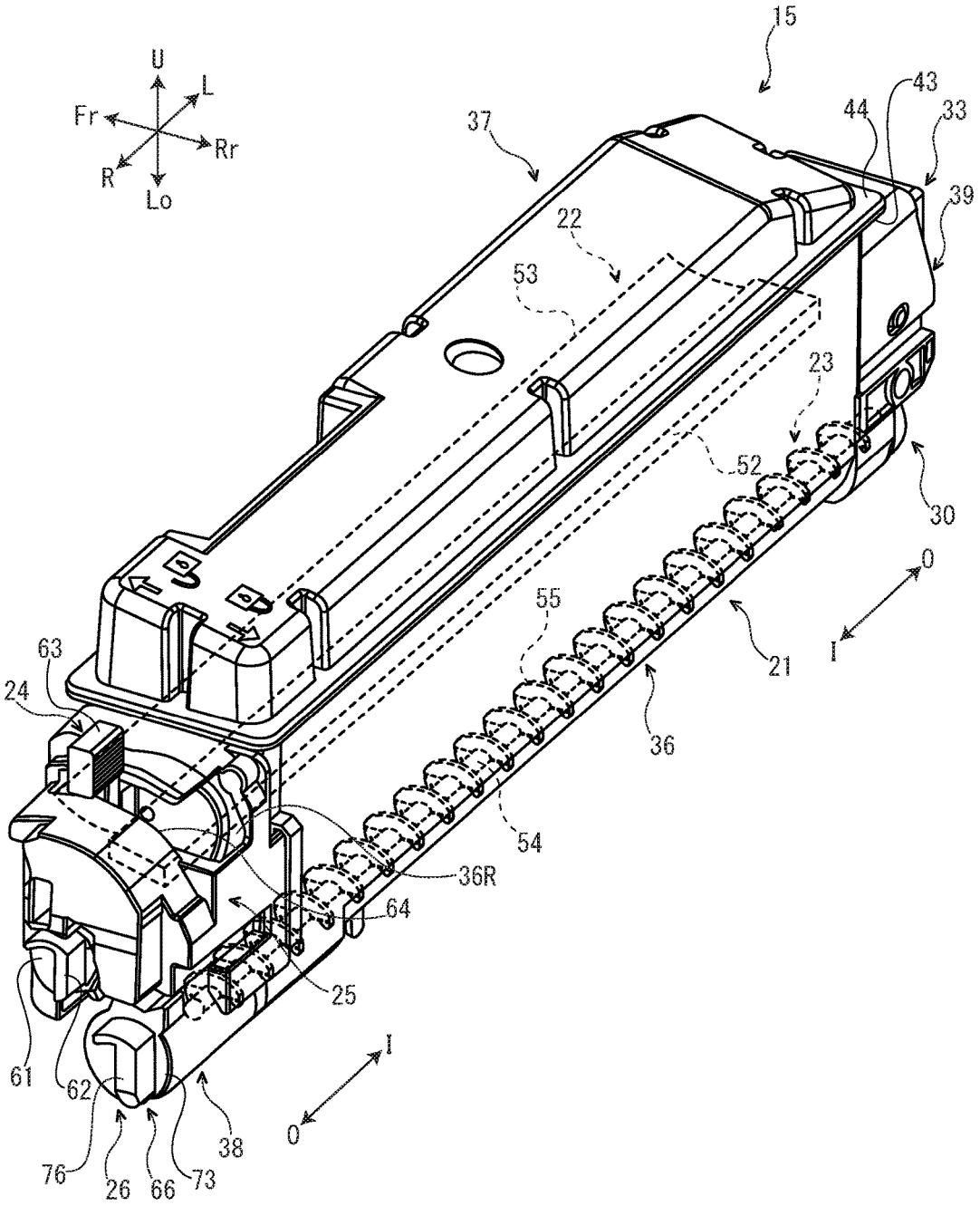
FIG. 2 is a perspective view showing a toner container according to the embodiment of the present disclosure.

An arrow O shown in each figure after FIG. 2 indicates an outside in the left-and-right direction of each toner container 15, and an arrow I shown in each figure after FIG. 2 indicates an inside in the left-and-right direction of each toner container 15.

Figure 3:
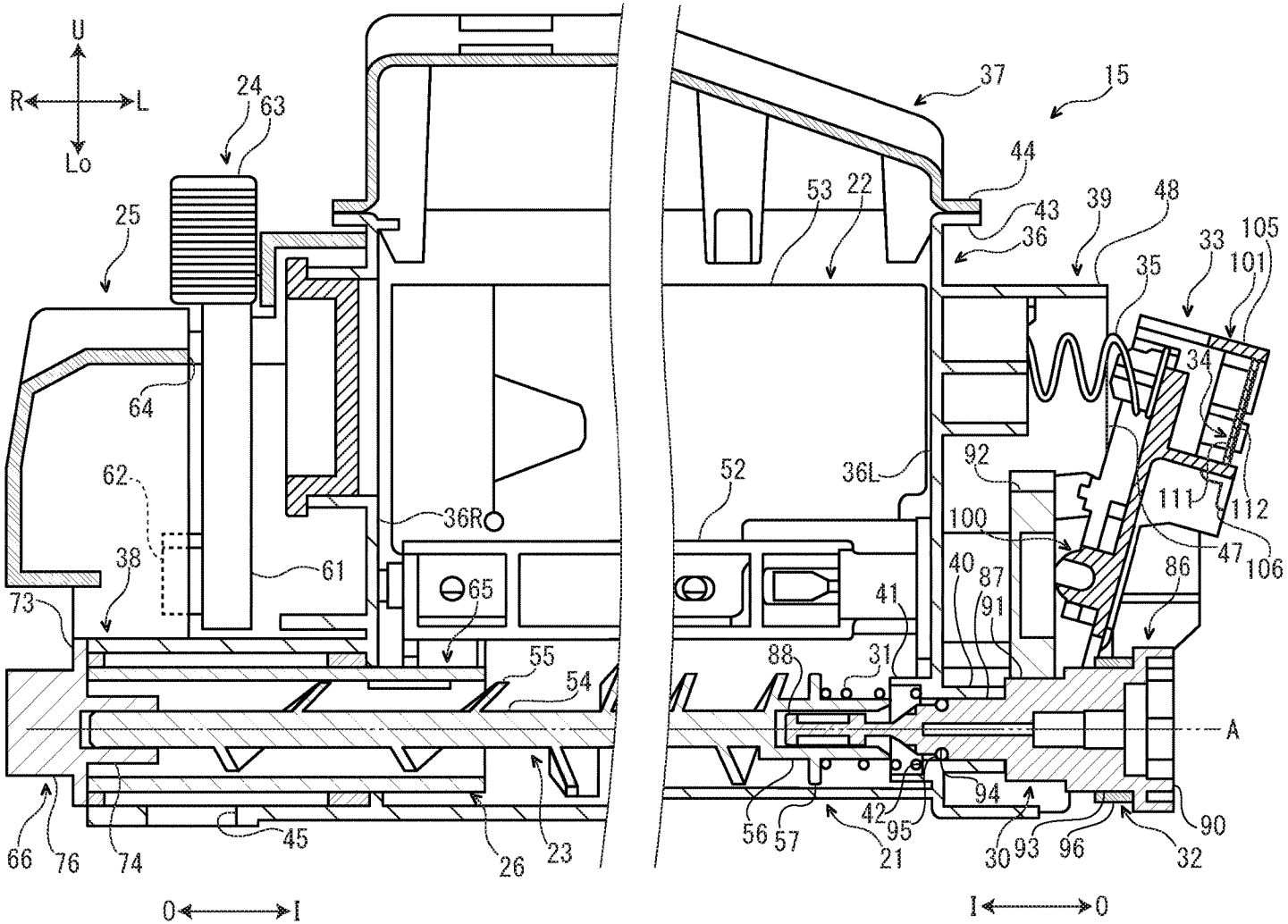
FIG. 3 is a sectional view showing a state where the toner container is detached from an attachment part, in the multifunctional peripheral according to the embodiment of the present disclosure.
Figure 4:
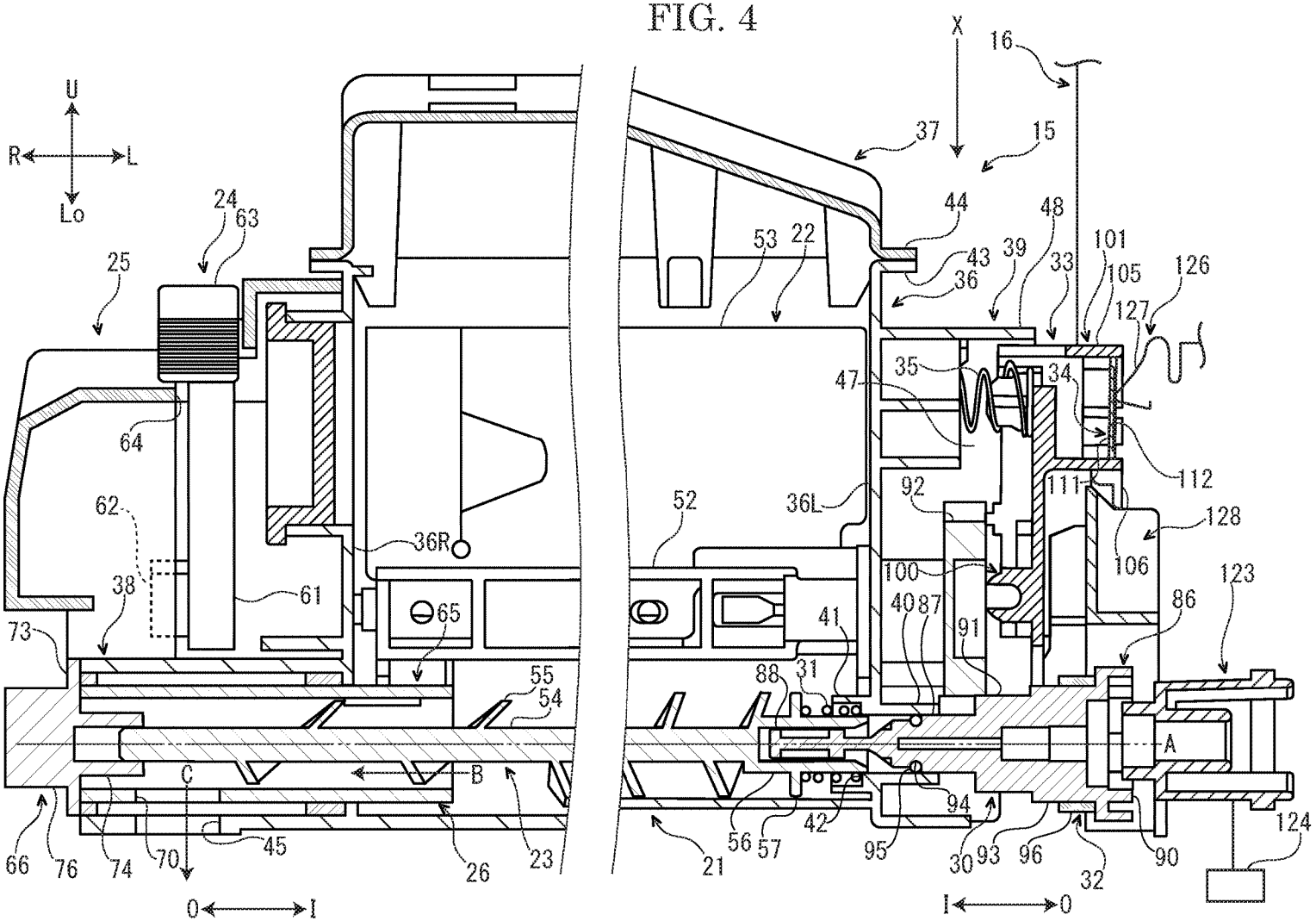
FIG. 4 is a sectional view showing a state where the toner container is attached to the attachment part, in the multifunctional peripheral according to the embodiment of the present disclosure.

With reference to FIG. 2 to FIG. 4, each toner container 15 includes a case main body 21, an agitator 22 stored in a center portion of the case main body 21, a conveyer 23 (an example of a rotator) stored in a rear lower portion of the case main body 21, a lever 24 (an example of a manipulation member) arranged at the right end side of the case main body 21, a cover 25 provided so as to cover the lever 24, a shutter 26 arranged at the lower side of the cover 25, a transmitter 30 arranged at the left end side of the case main body 21, a coil spring 31 (an example of a biasing member) arranged at the right side of the transmitter 30, a bearing 32 mounted to a left side portion of the transmitter 30, a turner 33 arranged at the upper side of the transmitter 30, a communication board 34 fixed to a left upper portion of the turner 33 and a biasing body 35 arranged at the right side of the turner 33.

The case main body 21 of each toner container 15 stores the toner (the developer). The case main body 21 includes a storage 36, a lid 37 provided at the upper side of the storage 36, a duct 38 provided at the right lower side of the storage 36 and a supporting frame 39 provided at the left side of the storage 36.

The storage 36 of the case main body 21 is formed in a box-like shape whose upper side is opened. The storage 36 is elongated in the left-and-right direction. On a lower portion of a left side wall 36L of the storage 36, an outer cylindrical part 40 is protruded toward the left side (the outside in the left-and-right direction) and an inner cylindrical part 41 is protruded toward the right side (the inside in the left-and-right direction). The outer cylindrical part 40 and the inner cylindrical part 41 are formed in a cylindrical shape extending along the left-and-right direction. On an inner circumferential face of the inner cylindrical part 41, a step portion 42 is formed. Around an upper end of an outer circumference of the storage 36, a lower side flange portion 43 is provided.

The lid 37 of the case main body 21 is formed in a box-like shape whose lower side is opened. Around a lower end of an outer circumference of the lid 37, an upper side flange portion 44 is provided. The upper side flange portion 44 is fixed to the lower side flange portion 43 of the storage 36. Thereby, the lid 37 is integrated with the storage 36. An inner space of the lid 37 is communicated with an inner space of the storage 36.

The duct 38 of the case main body 21 is formed in a cylindrical shape extending along the left-and-right direction. The duct 38 is formed integrally with the storage 36 of the case main body 21, and extends from a lower end portion of a right side wall 36R of the storage 36 toward the right side (the outside in the left-and-right direction). An inner space of the duct 38 is communicated with the inner space of the storage 36. On a lower face of the duct 38, a discharge port 45 through which the toner is discharged is provided.

Figure 5:
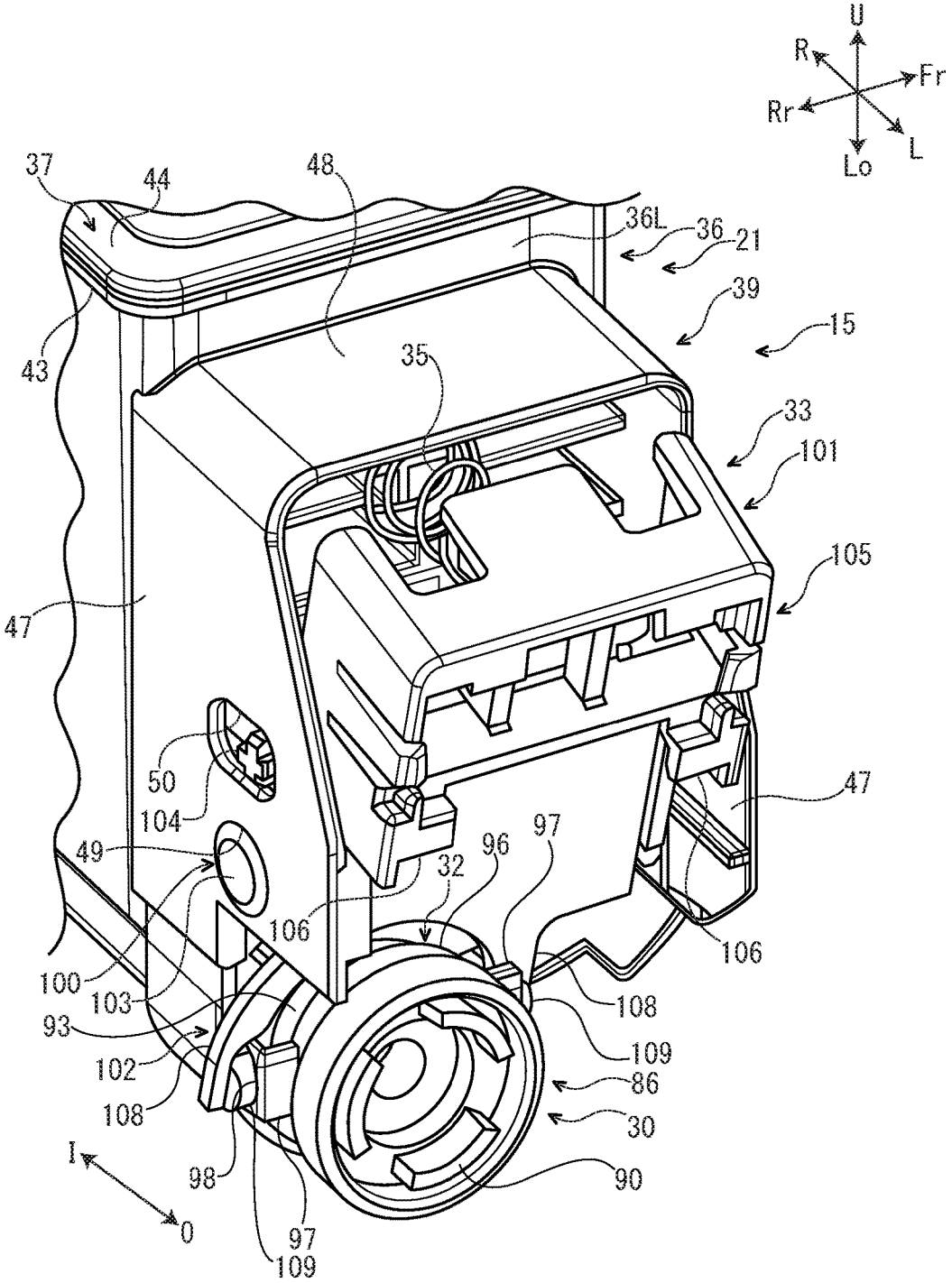
FIG. 5 is a perspective view showing a state where a transmitter is moved to a first position and a turner is turned in a first posture, in the toner container according to the embodiment of the present disclosure.
Figure 6:
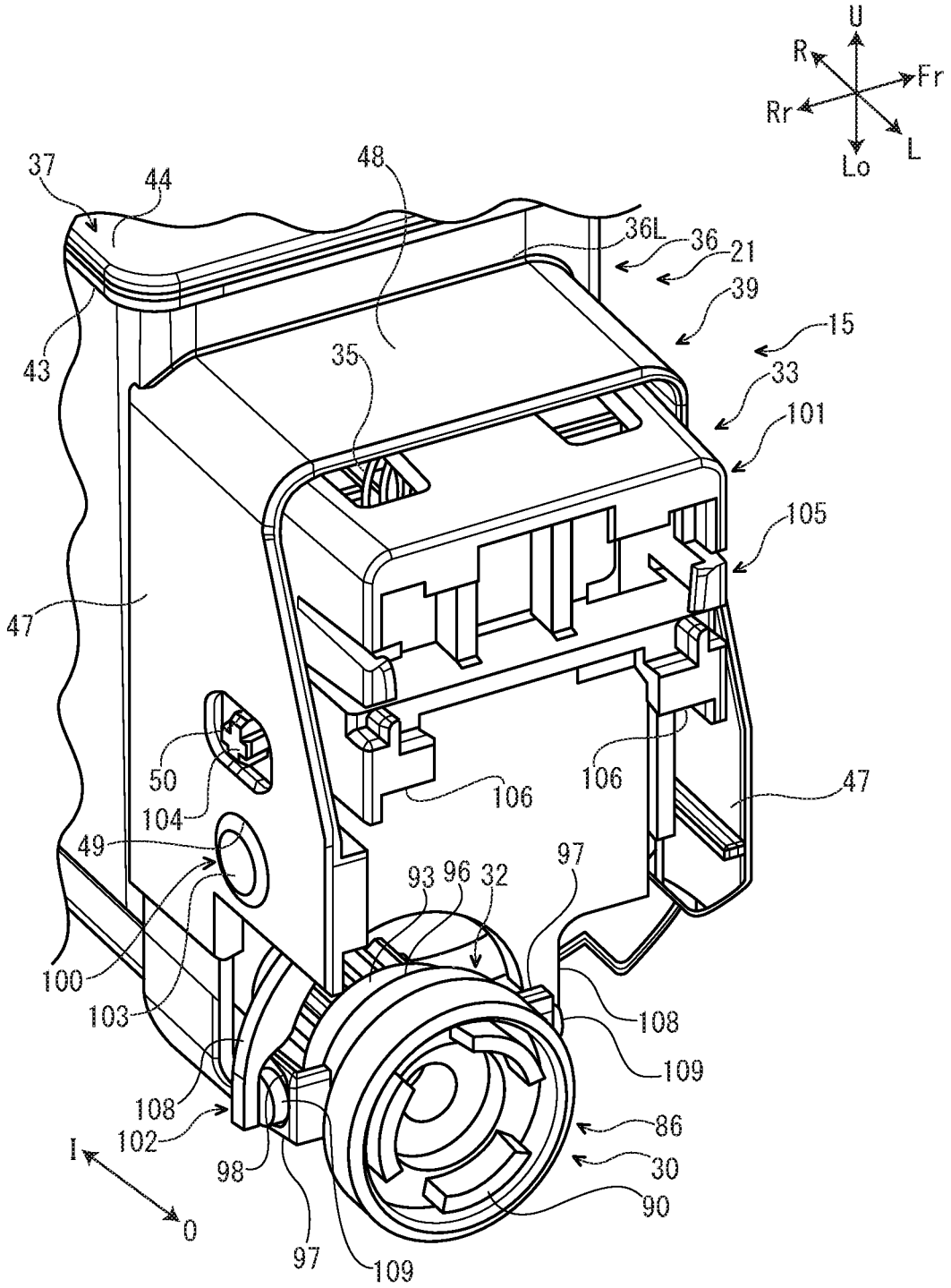
FIG. 6 is a perspective view showing a state where the transmitter is moved to a second position and the turner is turned in a second posture, in the toner container according to the embodiment of the present disclosure.

With reference to FIG. 5 and FIG. 6, the supporting frame 39 of the case main body 21 is formed integrally with the storage 36 of the case main body 21, and extends to the left side (the outside in the left-and-right direction) from the left side wall 36L of the storage 36. The supporting frame 39 includes a pair of front and rear side plates 47 and a top plate 48 connecting upper end portions of the pair of front and rear side plates 47. In a lower portion of each side plate 47, an axial hole 49 is provided. In a center portion of each side plate 47 in the upper-and-lower direction, a guide hole 50 is provided. The guide hole 50 is elongated in the left-and-right direction.

With reference to FIG. 2 to FIG. 4, the agitator 22 of each toner container 15 is stored in the storage 36 of the case main body 21. The agitator 22 is rotatable. The agitator 22 includes an agitating shaft 52 and an agitating blade 53 mounted to the agitating shaft 52. The agitating shaft 52 extends along the left-and-right direction. The agitating blade 53 is made of resin film, for example, and formed in a sheet-like shape.

With reference to FIG. 3 and FIG. 4, a left side portion and a center portion in the left-and-right direction of the conveyer 23 of each toner container 15 are stored in the storage 36 of the case main body 21. Aright side portion of the conveyer 23 is stored in the duct 38 of the case main body 21. The conveyer 23 is rotatable around a rotation axis A extending along the left-and-right direction. That is, in the present embodiment, the left-and-right direction is a rotation axis direction of the conveyer 23. The conveyer 23 is movable along the left-and-right direction with respect to the case main body 21.

The conveyer 23 includes a conveying shaft 54 extending along the left-and-right direction and a spiral conveying fin 55 protruding on an outer circumference of the conveying shaft 54. On a left end portion of the conveying shaft 54, a cylindrical shaped coupling cylindrical part 56 is provided.

On an outer circumferential face of the coupling cylindrical part 56, an annular platform portion 57 is protruded.

The lever 24 of each toner container 15 is arranged at the right side (the outside in the left-and-right direction) of the case main body 21. The lever 24 includes a fulcrum part 61, a drive protruding part 62 protruding on a right face (a face at the outside in the left-and-right direction) of the fulcrum part 61 and a manipulated part 63 extending upward from the fulcrum part 61. The lever 24 is supported by the right side wall 36R of the storage 36 of the case main body 21 so as to be rotatable around the fulcrum part 61.

The cover 25 of each toner container 15 is fixed to the storage 36 of the case main body 21, and covers the right side wall 36R of the storage 36 from the right side (the outside in the left-and-right direction). In an upper portion of the cover 25, a window 64 is provided. Through the window 64, an upper end portion of the manipulated part 63 of the lever 24 is exposed to an outside of each toner container 15.

The shutter 26 of each toner container 15 is arranged at the right end side of the conveyer 23. The shutter 26 includes a main body part 65 and a closing part 66 attached to a right end portion (an end portion at the outside in the left-and-right direction) of the main body part 65.

The main body part 65 of the shutter 26 is formed in a cylindrical shape extending along the left-and-right direction. In the main body part 65, the right side portion of the conveyer 23 is stored. The main body part 65 is rotatably attached to an inner circumference of the duct 38. Thereby, the shutter 26 is rotatable between a closing position (refer to FIG. 3) where the main body part 65 closes the discharge port 45 of the duct 38 and an opening position (refer to FIG. 4) where the main body part 65 opens the discharge port 45 of the duct 38.

The main body part 65 of the shutter 26 has a communication port 70. The communication port 70 is not communicated with the discharge port 45 of the duct 38 in a state where the shutter 26 is rotated to the closing position, and is communicated with the discharge port 45 of the duct 38 in a state where the shutter 26 is rotated to the opening position.

The closing part 66 of the shutter 26 is fixed to the main body part 65 of the shutter 26. The closing part 66 includes a flat plate part 73, a supporting cylindrical part 74 protruding on a left face (a face at the inside in the left-and-right direction) of the flat plate part 73 and a driven protruding part 76 protruding on a right face (a face at the outside in the left-and-right direction) of the flat plate part 73. The flat plate part 73 is formed in a flat plate-like shape along a face perpendicular to the left-and-right direction. The flat plate part 73 closes the right end portion (the end portion at the outside in the left-and-right direction) of the main body part 65 of the shutter 26. Into the supporting cylindrical part 74, a right end portion of the conveying shaft 54 of the conveyer 23 is rotatably inserted.

With reference to FIG. 3 and FIG. 4, the transmitter 30 of each toner container 15 is arranged on the left end side of the conveyer 23. The transmitter 30 penetrates through the outer cylindrical part 40 and the inner cylindrical part 41 which are provided on the left side wall 36L of the storage 36 of the case main body 21.

The transmitter 30 is movable along the left-and-right direction between a first position (refer to FIG. 3) and a second position (refer to FIG. 4) which is arranged at the left side (the outside in the left-and-right direction) of the first position. The transmitter 30 is rotatable around the rotation axis A.

The transmitter 30 includes an annular exposed piece 86, an inserted piece 87 protruding to the right side (the inside in the left-and-right direction) from the exposed piece 86 and a coupled piece 88 protruding to the right side (the inside in the left-and-right direction) from the inserted piece 87.

The exposed piece 86 of the transmitter 30 is exposed to the outside of the case main body 21. On a left face (a face at the outside in the left-and-right direction) of the exposed piece 86, a transmitting coupling 90 is provided. Around an outer circumferential face of the exposed piece 86, a transmitting gear 91 is formed. The transmitting gear 91 is connected to the agitating shaft 52 of the agitator 22 via a connecting gear 92. On the outer circumferential face of the exposed piece 86, a mounting face 93 is provided at the left side (the outside in the left-and-right direction) of the transmitting gear 91.

The inserted piece 87 of the transmitter 30 is inserted into the outer cylindrical part 40 provided on the left side wall 36L of the storage 36 of the case main body 21. Around an outer circumferential face of the inserted piece 87, an annular attachment groove 94 is provided, and an annular seal member 95 is fitted in the attachment groove 94. The seal member 95 comes into contact with an inner circumferential face of the outer cylindrical part 40.

The coupled piece 88 of the transmitter 30 is inserted into the coupling cylindrical part 56 of the conveying shaft 54 of the conveyer 23, and coupled to the coupling cylindrical part 56. Thereby, the transmitter 30 is fixed to the left end portion of the conveying shaft 54.

The coil spring 31 of each toner container 15 is arranged at the left end side of the conveyer 23. The coil spring 31 is mounted around the coupling cylindrical part 56 of the conveying shaft 54 of the conveyer 23. The coil spring 31 is arranged at an inner circumference side of the inner cylindrical part 41 provided on the left side wall 36L of the storage 36 of the case main body 21. The coil spring 31 is interposed between the step portion 42 formed on the inner circumferential face of the inner cylindrical part 41 and the platform portion 57 protruding on the outer circumferential face of the coupling cylindrical part 56. The coil spring 31 presses the conveyer 23 to the right side to bias the transmitter 30 fixed to the conveyer 23 to the first position (refer to FIG. 3).

Figure 7:
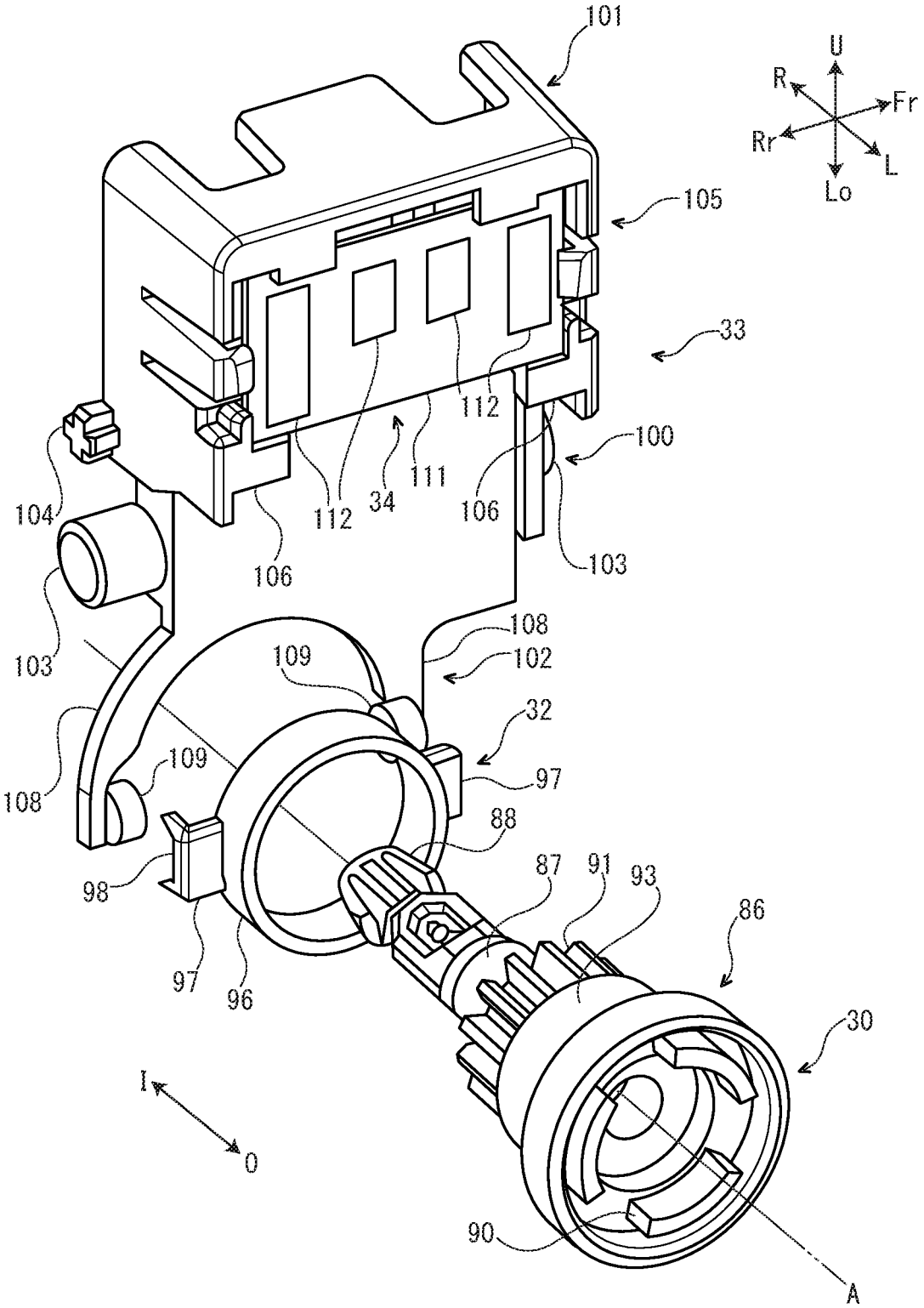
FIG. 7 is a disassembled perspective view showing the transmitter, a bearing, the turner and a communication board, in the toner container according to the embodiment of the present disclosure.

With reference to FIG. 5 to FIG. 7, the bearing 32 of each toner container 15 includes a mounted piece 96 and a pair of front and rear pressed pieces 97 provided on an outer circumference of the mounted piece 96. The mounted piece 96 is formed in a cylindrical shape extending along the left-and-right direction. The mounted piece 96 is mounted to the mounting face 93 of the exposed piece 86 of the transmitter 30. Thereby, the bearing 32 holds the transmitter 30 rotatably. The pair of front and rear pressed pieces 97 protrudes outward in a radial direction from front and rear side portions of the outer circumferential face of the mounted piece 96 respectively. On a right face (a face at the inside in the left-and-right direction) of the rear pressed piece 97, an engagement groove 98 is provided.

The turner 33 of each toner container 15 is provided at the left side (the outside in the left-and-right direction) of the case main body 21. The turner 33 includes a turning shaft part 100, a first turning part 101 provided at the upper side (a first side in the upper-and-lower direction) of the turning shaft part 100 and a second turning part 102 provided at the lower side (a second side in the upper-and-lower direction) of the turning shaft part 100.

On both front and rear side faces of the turning shaft part 100 of the turner 33, a boss 103 is protruded. Each boss 103 is engaged with the axial hole 49 provided on each side plate 47 of the supporting frame 39 of the case main body 21. Thereby, the turner 33 is turnable around the turning shaft part 100 between a first posture (refer to FIG. 5) and a second posture (refer to FIG. 6) where the first turning part 101 is moved to the right side (the inside in the left-and-right direction) farther than the first posture and the second turning part 102 is moved to the left side (the outside in the left-and-right direction) farther than the first posture.

On both front and rear side faces of the first turning part 101 of the turner 33, a guide projection 104 is protruded. Each guide projection 104 is engaged with the guide hole 50 provided on each side plate 47 of the supporting frame 39 of the case main body 21. This regulates a turning range of the turner 33. On a left upper portion of the first turning part 101, a fixing part 105 is provided. On a left lower portion of the first turning part 101, a pair of front and rear protruding pieces 106 is protruded toward the lower side.

The second turning part 102 of the turner 33 includes a pair of front and rear arms 108 and a pair of front and rear engagement projections 109 protruding on inner circumferential faces of lower end portions (tip end portions) of the pair of front and rear arms 108. The pair of front and rear arms 108 is curved in an arc-shape around the rotation axis A. The pair of front and rear engagement projections 109 is formed in a columnar shape. The pair of front and rear engagement projections 109 comes into contact with the pair of front and rear pressed pieces 97 of the bearing 32. The rear engagement projection 109 is engaged with the engagement groove 98 provided in the rear pressed piece 97 in a movable state along the upper-and-lower direction (a direction crossing to the left-and-right direction). By the above described configuration, the transmitter 30 is connected to the second turning part 102 via the bearing 32.

With reference to FIG. 7, the communication board 34 of each toner container 15 stores various information regarding each toner container 15, such as a manufacturing number of the toner container 15. The communication board 34 includes a flat-shaped board body 111 and four terminals 112 mounted on a left face (a face at the outside in the left-and-right direction) of the board body 111. The board body 111 is fixed to the fixing part 105 of the first turning part 101 of the turner 33. The four terminals 112 are provided at intervals in the front-and-rear direction, and extend along the upper-and-lower direction. The communication board 34 is not shown in FIG. 5 and FIG. 6.

With reference to FIG. 3 and FIG. 4, the biasing body 35 of each toner container 15 is constructed by a coil spring, for example. The biasing body 35 is interposed between the left side wall 36L of the storage 36 of the case main body 21 and the first turning part 101 of the turner 33. The biasing body 35 biases the turner 33 to the first posture (refer to FIG. 5).

Next, the attachment part 16 will be described in detail.

Figure 8:
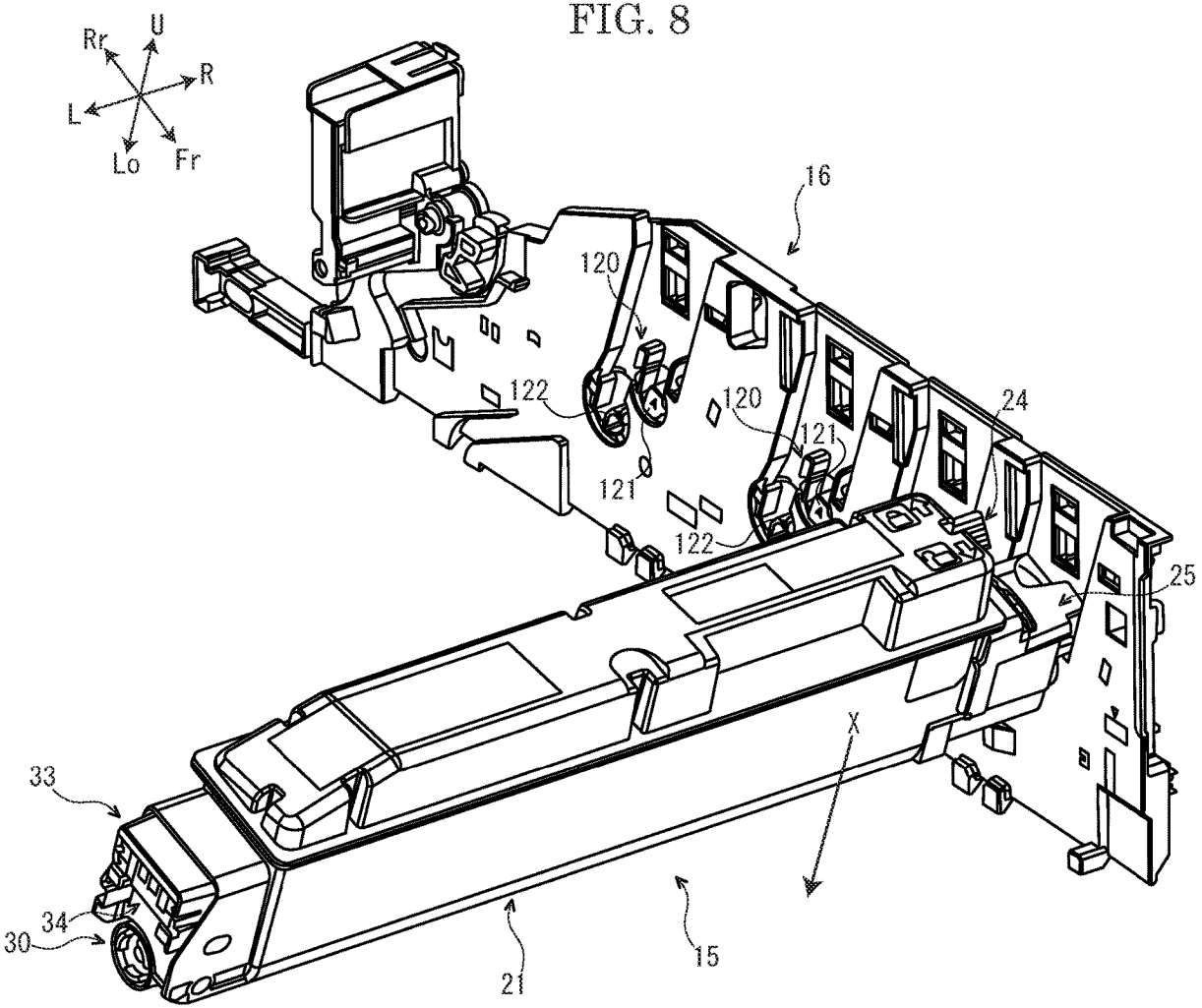
FIG. 8 is a perspective view showing the toner container and the attachment part, in the multifunctional peripheral according to the embodiment of the present disclosure.

With reference to FIG. 8, to the attachment part 16, each toner container 15 (one of them is only shown in FIG. 8) is detachably attached along an attachment direction X from the upper side to the lower side. In the attachment part 16, four connecting mechanisms 120 (two of them are only shown in FIG. 8) are provided at the right sides of attachment positions of the toner containers 15. Each connecting mechanism 120 includes a first connecting member 121 and a second connecting member 122 connected to the first connecting member 121 via a gear part (not shown). The first connecting member 121 is engaged with the drive protruding part 62 of the lever 24 of each toner container 15 in a state where each toner container 15 is attached to the attachment part 16. The second connecting member 122 is engaged with the driven protruding part 76 of the shutter 26 of each toner container 15 in the state where each toner container 15 is attached to the attachment part 16. As described above, each connecting mechanism 120 connects the lever 24 to the shutter 26 in the state where each toner container 15 is attached to the attachment part 16.

Figure 9:
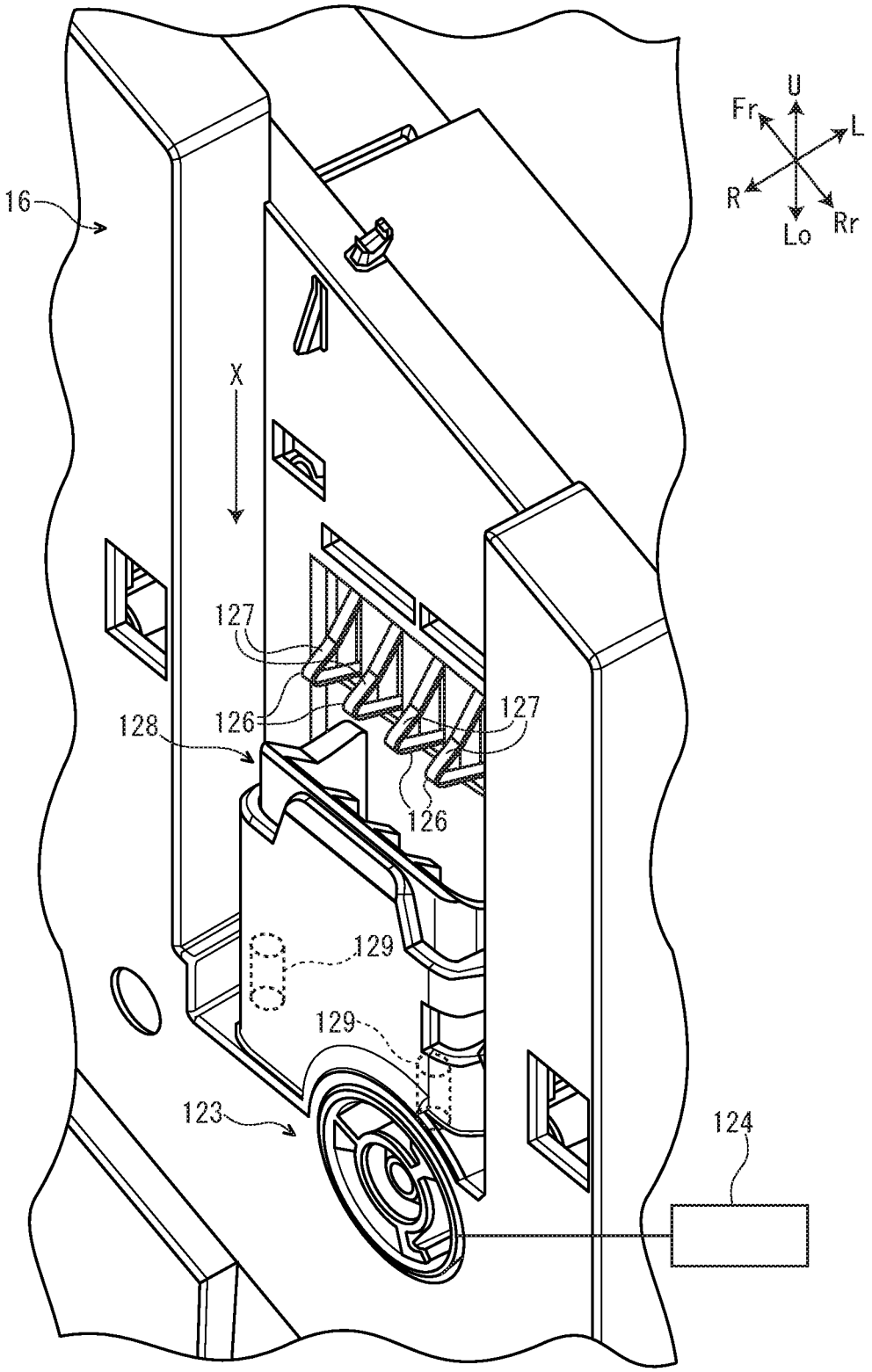
FIG. 9 is a perspective view showing a state where a shield member is moved to an exposing position, in the multifunctional peripheral according to the embodiment of the present disclosure.
Figure 10:
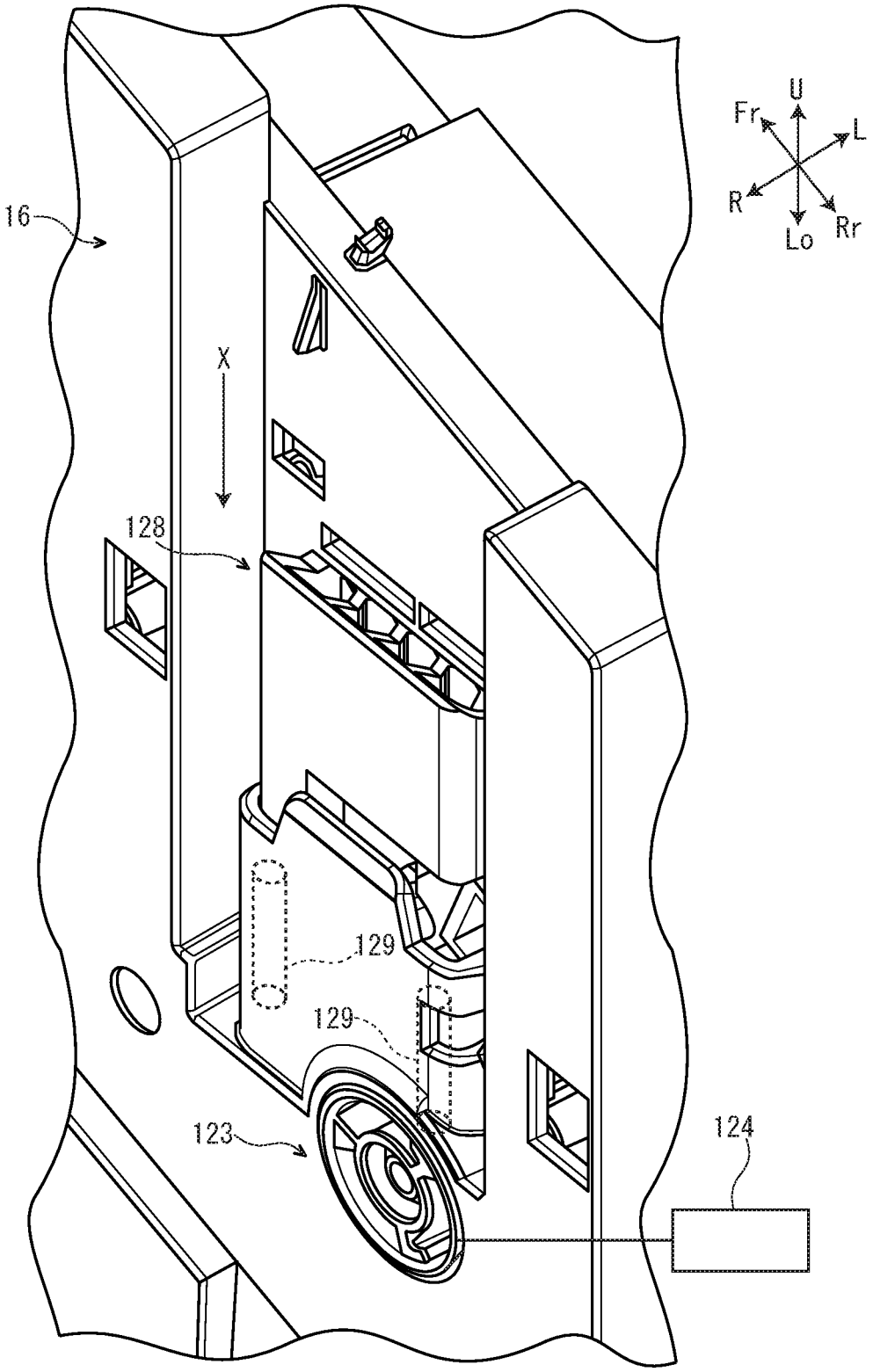
FIG. 10 is a perspective view showing a state where the shield member is moved to a covering position, in the multifunctional peripheral according to the embodiment of the present disclosure.

With reference to FIG. 9 and FIG. 10, in the attachment part 16, four driving couplings 123 (one of them is only shown in FIG. 9 and FIG. 10) are provided at the left sides of the attachment positions of the toner containers 15. Each driving coupling 123 is connected to a driving source 124 constituted by a motor and the others, and configured to be driven by driving force from the driving source 124 to be rotated.

In the attachment part 16, four communication contacts 126 are provided at the upper side of each driving coupling 123. The four communication contacts 126 are provided at intervals in the front-and-rear direction. On a right face of each communication contact 126, an inclined face 127 is provided. The inclined face 127 is inclined to the right side toward the lower side (a downstream side in the attachment direction X).

In the attachment part 16, a shield member 128 is provided at the upper side of each driving coupling 123. Each shield member 128 is movable along the upper-and-lower direction between an exposing position (refer to FIG. 9) where each communication contact 126 is exposed and a covering position (refer to FIG. 10) where each communication contact 126 is covered. Each shield member 128 is biased to the covering position by a pair of front and rear biasing pieces 129. The pair of front and rear biasing pieces 129 is constructed by a coil spring, for example.

In the multifunctional peripheral 1 having the above described configuration, an operation to replenish the developing device 8 of the image forming part 6 with the toner from the toner container 15 will be described on an assumption that the toner container 15 is attached to the attachment part 16.

When the developing device 8 of the image forming part 6 is replenished with the toner from the toner container 15, in a state (refer to FIG. 4) where the transmitting coupling 90 of the toner container 15 is coupled to the driving coupling 123 and the discharge port 45 of the toner container 15 is opened, the driving source 124 is operated. When the driving source 124 is operated, the driving coupling 123 is rotated by driving force from the driving source 124. When the driving coupling 123 is rotated, rotation of the driving coupling 123 is transmitted to the agitating shaft 52 of the agitator 22 by the transmitter 30 and the connecting gear 92 to rotate the agitator 22. Consequently, the toner stored in the storage 36 of the case main body 21 is agitated by the agitator 22.

Additionally, when the driving coupling 123 is rotated as described above, the rotation is transmitted to the conveyer 23 by the transmitter 30 to rotate the conveyer 23. Consequently, as shown by an arrow B in FIG. 4, the toner stored in the storage 36 and the duct 38 of the case main body 21 is conveyed by the conveyer 23 toward the discharge port 45. The toner conveyed toward the discharge port 45 is, as shown by an arrow C in FIG. 4, discharged outside the toner container 15 through the discharge port 45. The toner discharged through the discharge port 45 is replenished to the developing device 8 of each image forming part 6 via a replenishment duct (not shown).

Next, in the multifunctional peripheral 1 having the above described configuration, an operation to open and close the discharge port 45 will be described on an assumption that the toner container 15 is attached to the attachment part 16.

When the shutter 26 is moved to the closing position, as shown in FIG. 3, the main body part 65 of the shutter 26 closes the discharge port 45.

In a state where the shutter 26 is moved to the closing position, when a worker, such as a user and a serviceman, rotates the lever 24 in one direction, rotation of the lever 24 is transmitted to the shutter 26 via the connecting mechanism 120 to rotate the shutter 26 from the closing position to the opening position. Thereby, as shown in FIG. 4, the main body part 65 of the shutter 26 opens the discharge port 45.

On the other hand, in a state where the shutter 26 is moved to the opening position, when the worker rotates the lever 24 in an opposite direction to the above one direction, the rotation of the lever 24 is transmitted to the shutter 26 via the connecting mechanism 120 to rotate the shutter 26 from the opening position to the closing position. Thereby, as shown in FIG. 3, the main body part 65 of the shutter 26 closes the discharge port 45.

Next, in the multifunctional peripheral 1 having the above described configuration, an operation to attach and detach the toner container 15 with respect to the attachment part 16 will be described.

With reference to FIG. 3 and FIG. 5, in a state where the toner container 15 is detached from the attachment part 16, the turner 33 is held in the first posture by the biasing force of the biasing body 35 and the transmitter 30 is held in the first position by the biasing force of the coil spring 31.

Figure 11:
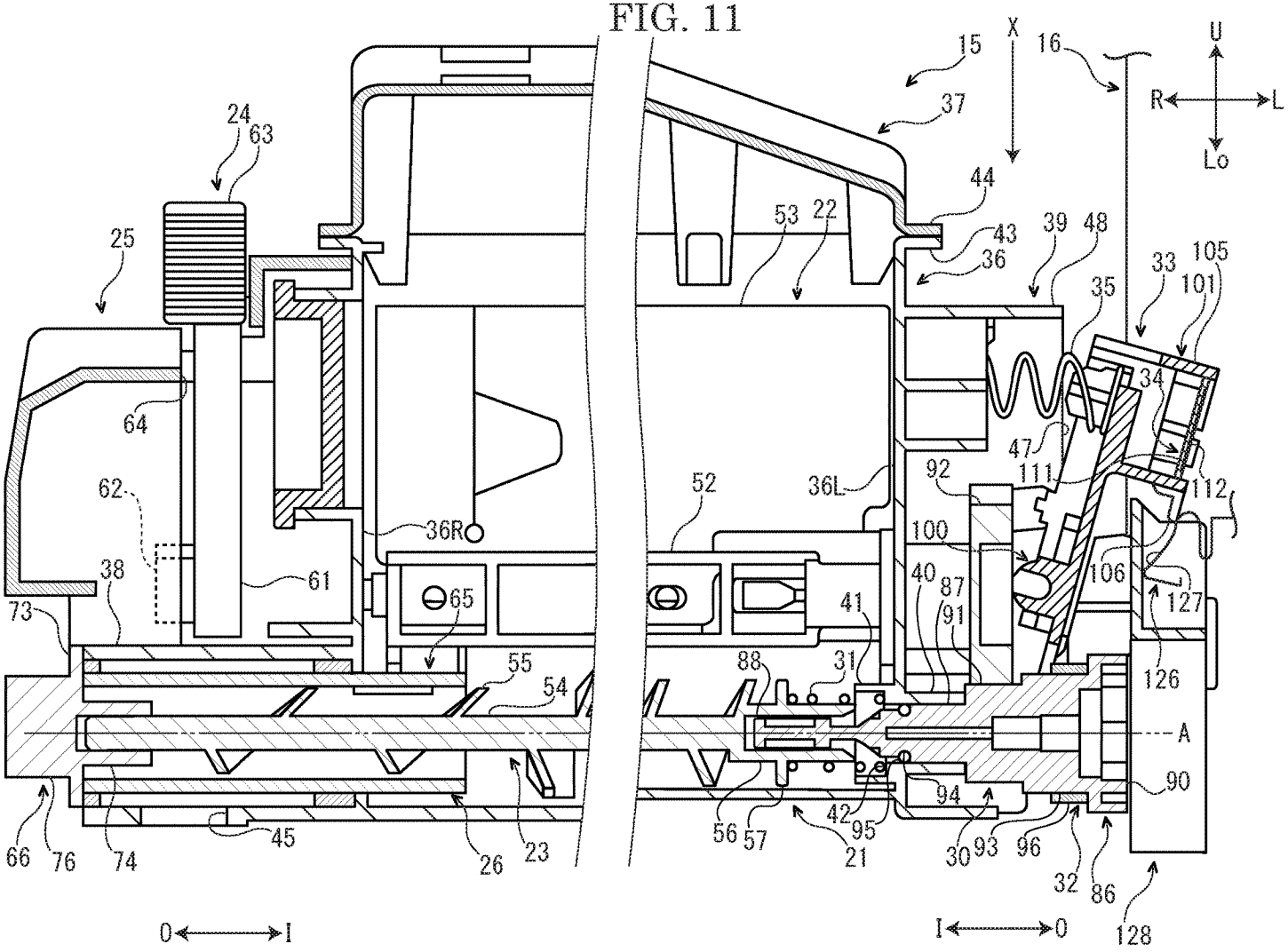
FIG. 11 is a sectional view showing a state just before the toner container is attached to the attachment part, in the multifunctional peripheral according to the embodiment of the present disclosure.

When the toner container 15 is attached to the attachment part 16, the worker, such as a user and a serviceman, inserts the toner container 15 to the attachment part 16 along the attachment direction X. When the toner container 15 is inserted to a predetermined position in the attachment part 16, as shown in FIG. 11, each protruding piece 106 of the turner 33 comes into contact with the inclined face 127 of each communication contact 126. From this state, when the worker inserts the toner container 15 to the attachment part 16 along the attachment direction X further, the inclined face 127 of each communication contact 126 presses each protruding piece 106 of the turner 33 to the right side. As shown in FIG. 4 and FIG. 6, this pressing turns the turner 33 from the first posture to the second posture against the biasing force of the biasing body 35. Consequently, the first turning part 101 of the turner 33 is moved to the right side (the inside in the left-and-right direction) and the second turning part 102 of the turner 33 is moved to the left side (the outside in the left-and-right direction). When the second turning part 102 is moved to the left side, each engagement projection 109 of the second turning part 102 presses each pressed piece 97 of the bearing 32 to move the bearing 32 to the left side (the outside in the left-and-right direction), and the transmitter 30 held by the bearing 32 is moved from the first position to the second position. As a result, the transmitting coupling 90 of the transmitter 30 is coupled to the driving coupling 123.

As the toner container 15 is attached to the attachment part 16, each protruding piece 106 of the turner 33 presses the shield member 128 to the lower side, and the shield member 128 is moved from the covering position to the exposing position against the biasing force of each biasing piece 129 to expose each communication contact 126. Additionally, as the toner container 15 is attached to the attachment part 16 as described above, each communication contact 126 is electrically connected to each terminal 112 of the communication board 34. This allows contact type communication between the toner container 15 and the attachment part 16.

In such a state where the toner container 15 is attached to the attachment part 16, each communication contact 126 presses the communication board 34 fixed to the first turning part 101 of the turner 33 to the right side (the inside in the left-and-right direction). As a result, the turner 33 is held in the second posture against the biasing force of the biasing body 35 and the transmitter 30 is held in the second position against the biasing force of the coil spring 31.

When the toner container 15 is detached from the attachment part 16, the worker pulls out the toner container 15 from the attachment part 16 along a direction opposite to the attachment direction X. When the toner container 15 is detached from the attachment part 16, each communication contact 126 is separated from each terminal 112 of the communication board 34. This releases the pressing of each communication contact 126 to the communication board 34 to turn the turner 33 from the second posture to the first posture by the biasing force of the biasing body 35. Consequently, the transmitter 30 is moved from the second position to the first position by the biasing force of the coil spring 31.

Additionally, as the toner container 15 is detached from the attachment part 16 as described above, the pressing of each protruding piece 106 of the turner 33 to the shield member 128 is released. As a result, the shield member 128 is moved from the exposing position to the covering position by the biasing force of each biasing piece 129 so that each communication contact 126 is covered with the shield member 128.

In the present embodiment, as described above, the turner 33 is configured to be turnable between the first posture and the second posture, and the second turning part 102 is moved to the left side (the outside in the left-and-right direction) as the turner 33 is turned from the first posture to the second posture, the transmitter 30 is configured to be movable between the first position and the second position arranged at the left side (the outside in the left-and-right direction) of the first position, and as the turner 33 is turned from the first posture to the second posture, the transmitter 30 is moved from the first position to the second position. By applying such a configuration, it becomes possible to move the transmitter 30 to the left side by a simple structure and to suppress the complication of the structure of the toner container 15.

Additionally, the turner 33 includes the turning shaft part 100 around which the turner 33 is turned, the first turning part 101 provided at the upper side (one side in the upper-and-lower direction) of the turning shaft part 100 and the second turning part 102 provided at the lower side (another side in the upper-and-lower direction) of the turning shaft part 100, the first turning part 101 is moved to the right side (the inside in the left-and-right direction) as the turner 33 is turned from the first posture to the second posture, the second turning part 102 is moved to the left side (the outside in the left-and-right direction) as the turner 33 is turned from the first posture to the second posture, and the transmitter 30 is connected to the second turning part 102. By applying such a configuration, it becomes possible to move the turner 33 from the first posture to the second posture easily by pressing the first turning part 101 to the right side.

Additionally, the toner container 15 includes the bearing 32 which holds the transmitter 30 rotatably, and as the turner 33 is turned from the first posture to the second posture, the second turning part 102 presses the bearing 32 to move the bearing 32 to the left side (the outside in the left-and-right direction) and the transmitter 30 held by the bearing 32 is moved from the first position to the second position. By applying such a configuration, it becomes possible to move the transmitter 30 from the first position to the second position surely without inhibiting the rotation of the transmitter 30.

Additionally, the bearing 32 has the engagement groove 98, and the second turning part 102 has the engagement projection 109 which is engaged with the engagement groove 98 in a movable state along the upper-and-lower direction (the direction crossing to the left-and-right direction). By applying such a configuration, the bearing 32 is allowed to be pressed by the second turning part 102 surely.

Additionally, the toner container 15 includes the coil spring 31 which biases the transmitter 30 to the first position, and as the turner 33 is turned from the second posture to the first posture, the transmitter 30 is moved from the second position to the first position by the biasing force of the coil spring 31. By applying such a configuration, it becomes possible to move the transmitter 30 from the second position to the first position surely as the turner 33 is turned from the second posture to the first posture.

Additionally, the case main body 21 includes the discharge port 45 through which the toner is discharged, the conveyer 23 which conveys the toner in the case main body 21 toward the discharge port 45 is movable along the left-and-right direction, and the transmitter 30 is fixed to the conveyer 23. By applying such a configuration, it becomes possible to move the transmitter 30 along the left-and-right direction smoothly.

Additionally, the multifunctional peripheral 1 includes the toner container 15 and the attachment part 16 to which the toner container 15 is detachably attached. By applying such a configuration, it becomes possible to replace the toner container 15 easily.

By the way, in some cases, with an opening and closing operation of a top cover (not shown) provided in the multifunctional peripheral main body 2 or the attachment operation of the toner container 15 to the attachment part 16, the driving coupling 123 is moved to be coupled to the transmitting coupling 90. However, to achieve such a configuration, the multifunctional peripheral main body 2 requires a driving mechanism to move the driving coupling 123, and therefore the multifunctional peripheral main body 2 may be complicated in its structure. Additionally, in a case where the driving coupling 123 is moved with the opening and closing operation of the top cover as described above, unless the top cover is completely opened, the coupling of the driving coupling 123 to the transmitting coupling 90 may not be released.

However, in the present embodiment, as the toner container 15 is attached to the attachment part 16, the attachment part 16 presses the turner 33 to turn the turner 33 from the first posture to the second posture, the transmitter 30 moves from the first position to the second position, and the transmitting coupling 90 is coupled to the driving coupling 123. By applying such a configuration, the multifunctional peripheral main body 2 does not require the driving mechanism to move the driving coupling 123 so that it becomes possible to suppress the complication of the structure of the multifunctional peripheral main body 2 and to perform space saving of the multifunctional peripheral main body 2. Additionally, because it becomes possible to release the coupling of the driving coupling 123 to the transmitting coupling 90 regardless of the operation of the members provided on the multifunctional peripheral main body 2, such as the top cover, a workability for the attachment and detachment of the toner container 15 to the attachment part 16 is improved.

Additionally, the toner container 15 further includes the communication board 34 fixed to the turner 33 and the attachment part 16 includes the communication contact 126 which is electrically connected to the communication board 34 as the toner container 15 is attached to the attachment part 16. By applying such a configuration, it becomes possible to use the turner 33 for the purpose for coupling of the driving coupling 123 to the transmitting coupling 90 and for the purpose for electrically connecting of the communication contact 126 to the communication board 34. This makes it possible to simplify the structure of the multifunctional peripheral 1.

In the present embodiment, the engagement groove 98 is provided in the bearing 32 and the engagement projection 109 which is engaged with the engagement groove 98 is provided in the second turning part 102. On the other hand, in another embodiment, the engagement projection 109 may be provided in the bearing 32 and the engagement groove 98 which is engaged with the engagement projection 109 may be provided in the second tuning part 102.

In the present embodiment, the transmitter 30 is connected to the second turning part 102 via the bearing 32. On the other hand, in another embodiment, the transmitter 30 may be directly connected to the second turning part 102.

In the present embodiment, the communication contact 126 of the attachment part 16 presses the turner 33 to turn the turner 33 from the first posture to the second posture. On the other hand, in another embodiment, the shield member 128 of the attachment part 16 may press the turner 33 to turn the turner 33 from the first posture to the second posture. In still another embodiment, a portion of the attachment part 16, other than the communication contact 126 and the shield member 128, may press the turner 33 to turn the turner 33 from the first posture to the second posture.

In the present embodiment, an entire part of the conveyer 23 is stored in the case main body 21. On the other hand, in another embodiment, a part of the conveyer 23 may be stored in the case main body 21.

In the present embodiment, a part of the transmitter 30 is exposed to the outside of the case main body 21. On the other hand, in another embodiment, an entire part of the transmitter 30 may be exposed to the outside of the case main body 21.

In the present embodiment, the main body part 65 of the shutter 26 is rotatably attached to the inner circumference of the duct 38 of the case main body 21. On the other hand, in another embodiment, the shutter 26 may be rotatably attached to the outer circumference of the duct 38 of the case main body 21.

In the present embodiment, the conveyer 23 is an example of the rotator. On the other hand, in another embodiment, the agitator 22 or the others may be an example of the rotator.

In the present embodiment, the discharge port 45 of each toner container 15 is connected to the developing device 8 of each image forming part 6 via the replenishment duct (not shown). On the other hand, in another embodiment, the discharge port 45 of each toner container 15 may be directly connected to the developing device 8 of each image forming part 6.

In the present embodiment, the lever 24 of each toner container 15 is connected to the shutter 26 via the connecting mechanism 120 of the attachment part 16. On the other hand, in another embodiment, the lever 24 of each toner container 15 may be directly connected to the shutter 26.

In the present embodiment, the configuration of the present disclosure is applied to the multifunctional peripheral 1. On the other hand, in still another embodiment, the configuration of the present disclosure may be applied to an image forming apparatus, such as a printer, a copying machine and a facsimile, other than the multifunctional peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body which stores a toner;

a rotator stored in the case main body and rotating around a rotation axis;

a transmitter which transmits rotation to the rotator, at least a part of the transmitter being exposed to an outside of the case main body; and a turner provided at an outside of the case main body in a rotation axis direction of the rotator, wherein the turner is turnable between a first posture and a second posture, at least a part of the turner moving to an outside in the rotation axis direction as the turner turns from the first posture to the second posture, and the transmitter is movable between a first position and a second position which is arranged at an outside of the first position in the rotation axis direction, and the transmitter moves from the first position to the second position as the turner turns from the first posture to the second posture.

2. The toner case according to claim 1, wherein the turner includes:

a turning shaft part around which the turner turns;

a first turning part provided at a first side of the turning shaft part; and a second turning part provided at a second side of the turning shaft part, wherein the first turning part moves to an inside in the rotation axis direction as the turner turns from the first posture to the second posture, the second turning part moves to the outside in the rotation axis direction as the turner turns from the first posture to the second posture, and the transmitter is connected to the second turning part.

3. The toner case according to claim 2, further comprising a bearing which rotatably holds the transmitter, wherein as the turner turns from the first posture to the second posture, the second turning part presses the bearing to move the bearing to the outside in the rotation axis direction, and the transmitter held by the bearing moves from the first position to the second position.

4. The toner case according to claim 3, wherein one of the bearing and the second turning part has an engagement groove, and another of the bearing and the second turning part has an engagement projection which is engaged with the engagement groove in a movable state along a direction crossing the rotation axis direction.

5. The toner case according to claim 2, wherein the first turning part is provided at an upper side of the turning shaft part, and the second turning part is provided at a lower side of the turning shaft part.

6. The toner case according to claim 2, further comprising a communication board which stores information about the toner case, wherein the communication board is fixed to the first turning part.

7. The toner case according to claim 2, wherein the case main body includes a supporting frame including a pair of side plates, and the turning shaft part is engaged with each of the side plates.

8. The toner case according to claim 1, further comprising a biasing member which biases the transmitter to the first position, wherein as the turner turns from the second posture to the first posture, the transmitter moves from the second position to the first position by biasing force of the biasing member.

9. The toner case according to claim 1, wherein the case main body has a discharge port through which the toner is discharged, the rotator is a conveyer which conveys the toner in the case main body toward the discharge port, the conveyer being movable along the rotation axis direction, and the transmitter is fixed to the conveyer.

10. An image forming apparatus comprising:

the toner case according to claim 1; and an attachment part to which the toner case is detachably attached.

11. The image forming apparatus according to claim 10, wherein the transmitter includes a transmitting coupling, the attachment part includes a driving coupling which is rotated by driving force of a driving source, and as the toner case is attached to the attachment part, the attachment part presses the turner to turn the turner from the first posture to the second posture, the transmitter moves from the first position to the second position, and the transmitting coupling is coupled to the driving coupling.

12. The image forming apparatus according to claim 10, wherein the toner case further includes a communication board fixed to the turner, and the attachment part includes a communication contact which comes into contact with the communication board as the toner case is attached to the attachment part.

* * * * *